US007231911B2

(12) United States Patent
Hatcher

(10) Patent No.: US 7,231,911 B2
(45) Date of Patent: Jun. 19, 2007

(54) ASSISTED TRIGGER MECHANISM

(76) Inventor: Forest A. Hatcher, 928 Lambert Ave., Flagler Beach, FL (US) 32136

( * ) Notice: Subject to any disclaimer, the term of this patent is extended or adjusted under 35 U.S.C. 154(b) by 0 days.

(21) Appl. No.: 10/912,269

(22) Filed: Aug. 5, 2004

(65) Prior Publication Data

US 2005/0178373 A1 Aug. 18, 2005

Related U.S. Application Data

(62) Division of application No. 09/990,504, filed on Nov. 21, 2001, now Pat. No. 6,802,305.

(60) Provisional application No. 60/252,230, filed on Nov. 21, 2000.

(51) Int. Cl.
*F41B 11/00* (2006.01)

(52) U.S. Cl. ..... 124/31; 124/74

(58) Field of Classification Search ..... 124/31, 124/73, 74, 75

See application file for complete search history.

(56) References Cited

U.S. PATENT DOCUMENTS 4,275,521 A 6/1981 Gerstenberger et al.
5,373,832 A * 12/1994 D'Andrade ..... 124/69
5,613,483 A * 3/1997 Lukas et al. ..... 124/73
5,890,479 A 4/1999 Morin
6,142,137 A 11/2000 MacLaughlin
6,343,599 B1 * 2/2002 Perrone ..... 124/73
6,481,429 B2 11/2002 Nishio et al.
6,550,468 B1 4/2003 Tippmann, Jr.
6,802,305 B1 10/2004 Hatcher

* cited by examiner

*Primary Examiner*—John A. Ricci
(74) *Attorney, Agent, or Firm*—Ryan, Kromholz & Manion S.C.

(57) ABSTRACT

A mechanical, pneumatic, magnetic and/or electronic method for assisting the user operation of a trigger and/or actively and rapidly returning the trigger mechanism to its firing position at the completion of a firing sequence in a paintball gun. The trigger assistance mechanism reduces the amount of force required by the user to move the trigger to begin the firing sequence. After the firing sequence has been completed, the trigger assistance mechanism provides assistance to the trigger to move it to its pre-firing resting position. Alternatively, the trigger assistance mechanism replaces the mechanical linkage between the trigger and the cocking/firing mechanism of the paintball gun such that a pneumatic actuating ram is used to initiate the cocking/firing sequence.

5 Claims, 5 Drawing Sheets

ASSISTED TRIGGER MECHANISM

CROSS-REFERENCE TO RELATED APPLICATIONS

The present application is a divisional application of U.S. patent application, Appln. No. 09/990,504, filed Nov. 21, 2001, and now U.S. Pat. No. 6,802,305, which is based on and claimed priority from U.S. Provisional Patent Application 60/252,230, filed on Nov. 21, 2000.

BACKGROUND OF THE INVENTION

The present invention generally relates to a mechanism for assisting the user in the operation of a trigger in a gun mechanism. More specifically, the present invention relates to a mechanical, pneumatic, magnetic or electronic method for assisting the user in the operation of a trigger and/or actively and rapidly returning the trigger mechanism to its firing position at the completion of a firing sequence for use with a paintball gun.

As the game and sport of paintball has grown, an increasing reliance on volume fire has evolved. This reliance on an increase in volume fire is evidenced by the introduction of electronically enhanced guns, improved paintball magazines and paintball feeding mechanisms, improved high speed valves and regulators and a host of other technologies all having a common goal of increasing the rate of fire from the paintball gun.

The goal of increasing the rate at which paintballs can be fired is complicated by an industry prohibition on "fully automatic" firing mechanisms, multiple shot weapons or other enhancements which allow the user to fire more than one paintball per trigger cycle of the weapon. Therefore, an objective throughout the paintball industry is to enhance the rate of fire through various means which maintain the operation of the paintball gun in a true "semi-automatic" firing mode in which one projectile is expelled per complete cycle of the trigger/gun mechanism. Further, a desire exists to eliminate, assist or equalize the force exerted by the use throughout the trigger cycle and to provide a powered or assisted method of returning the trigger to the ready position at the end of the firing sequence.

Despite previously mentioned solutions and enhancements, there are currently no methods available for an "assisted" trigger mechanism in a paintball gun. In principle, an assisted trigger mechanism utilizes the user's own mechanical action of pulling or releasing a trigger mechanism as the initiating force, after which mechanical, pneumatic, electronic, magnetic or a combination of these means is introduced and automatically perform some or all of the trigger cycle.

In currently available paintball guns, a simple trigger mechanism relies on mechanical force from the user to release a captured sear. A hammer, retained by the sear and under spring tension, is released, allowing the hammer to impact a valve stem, thereby opening the valve and firing a projectile and then, utilizing gas blowback to reset the sear.

In order to understand the scope of the present invention, it is necessary to understand that there are currently four "classes" of paintball gun design, each of which has a different configuration but all of which operate on the same principles of design.

The first of the four mechanisms of paintball gun operation is classified as a blowback configuration. This type of gun utilizes a mechanically operated sear connected to the trigger, a spring operated hammer connected mechanically to a bolt, and a spring operated valve mechanism. The bolt is located above the hammer in a separate body channel which is in communication with the gun barrel. In operation, the user first "cocks" the system by pulling a cocking knob connected to the bolt. This causes the hammer to be moved behind the sear and compresses the hammer spring.

When the trigger is pulled, the trigger actuates a sear, releasing the hammer. Under spring tension, the hammer moves forward. Since the bolt is connected to the hammer, when the hammer moves forward, the bolt moves forward as well to push a paintball into the barrel. When the bolt is at its furthest point of forward travel, a gas passage in the bolt is in communication with a vent hole from the valve. Simultaneously, the hammer impacts a valve stem in the face of the valve, opening the valve and releasing a preset amount of pressurized gas. This gas vents through the bolt, thus firing a paintball, and against the hammer, pushing the hammer and the bolt back into the cocked position. At its rearmost point of travel, the sear once again captures the hammer completing the cycle.

The next type of paintball gun uses a "blow forward" type of mechanism in which the bolt is retained by the sear, which is mechanically linked to the trigger. The bolt rides on a tube that communicates with the valve and is retained by the sear under pressure, effectively acting as a seal on the valve system. When the trigger is actuated, the bolt is released. Gas pressure from the valve pushes the bolt forward, which in turn pushes a paintball into the barrel. Once the bolt has reached its furthest point of travel, the gas passage is opened, allowing the gas to flow through the face of the bolt, thus firing the paintball. A spring located forward of the bolt returns the bolt where it is again captured by the sear, thus completing the cycle.

An "autococking" style of semi-automatic paintball guns operate in the same basic manner as the blowback semi-automatic. However, the design is based on what was originally a pump operated paintball gun where the pumping action has been pneumatically automated. This style of design therefore has several additional mechanisms.

In the autococking style mechanism, when the trigger is pulled, the hammer is released, striking the valve and sending gas through the bolt and down the barrel, thus firing a paintball. Gas is also vented to a low pressure regulator, which in turn supplies a three-way valve. The three-way valve is connected to a pneumatic ram, which in turn is mechanically linked to a cocking mechanism and to the bolt.

Gas from the regulator is introduced into the three-way valve which first operates the ram to push the cocking mechanism rearward, pulling the bolt back, allowing a new projectile to enter the barrel and resetting the hammer on the sear. Gas is then vented from the three-way valve, which operates to reverse the flow of gas to the ram, which in turn pulls the bolt and cocking mechanism forward, completing the cycle.

The final type of paintball gun is classified as an electric paintball gun. In some cases, electric paintball guns replaced some or all of the mechanical systems mentioned above with electronic or electromechanical systems. For example, one widely distributed model substitutes an electronic switch connected to a solenoid for the mechanical sear.

In each of the types of paintball guns discussed above, the firing rate of paintballs is limited by the rate at which a human finger can depress and release the trigger of the paintball gun. Since the rate at which a human finger can pull a trigger is somewhat limited by the mechanical action of the trigger mechanism, it is an object of the present invention to provide assistance to the user when pulling the trigger and actively assist in returning the trigger to its initial position.

SUMMARY OF THE INVENTION

The present invention relates to an assisted trigger mechanism used to aid a paintball gun user in the depression and release of a trigger during the firing sequence of a paintball. The assisted trigger mechanism allows the user to complete the firing sequence in less time and using less effort, thus allowing the user to increase the number of paintballs fired during a given time period.

In the first embodiment of the invention, a secondary magnet or electromagnet is positioned behind the trigger in the trigger housing. The secondary magnet in the trigger housing is used to attract the trigger during initial movement of the trigger rearward, while the polarity of the secondary magnet can be reversed to repel the trigger once the paintball has been fired.

In another embodiment of the invention, the trigger itself is configured as part of an electromagnet. User actuation of the trigger causes the circuit between the trigger/electromagnet and a power supply to be closed. The magnetic field thus created causes the trigger to be attracted to a secondary magnet behind the trigger while being simultaneously repelled by a secondary magnet positioned in front of the trigger. Once the trigger has traveled past the point where it actuates the sear mechanism of the paintball gun, the circuit to the trigger electromagnetic is opened, causing a cessation of the magnetic field. Once the trigger has traveled a minute but discernable distance beyond that required to cause a firing event, the circuit is again closed such that the polarity of the trigger electromagnet is reversed. At this point in the trigger cycle, the magnetic field repels the trigger from the secondary magnet positioned behind the trigger, while the secondary magnet in front of the trigger acts to attract the trigger.

In another alternate embodiment, an adjustment mechanism consisting of a non-ferrous "field strength reducer" is positioned between the secondary magnet in the trigger housing and the trigger. The field strength reducer, when placed between the secondary magnet and the trigger, reduces the strength of the magnetic field emanating from the secondary magnet. The type and size of the field strength reducer can be selected to vary the amount of assistance provided by the secondary magnet.

In a further embodiment of the invention, the magnets can be replace by a single or a pair of solenoids that are mechanically linked to the trigger. Movement of the trigger during the firing sequence causes activation of the solenoids which extend their solenoid rods to aid in movement of the trigger during the firing sequence.

In another embodiment of the invention, Hall effect sensors are attached to the electromagnets positioned in the trigger housing. As the trigger is depressed, the change in the field strength monitored by the sensors will alternately cause either power to be transmitted to the electromagnet, the polarity of the magnet change, or power will be cut off to the electromagnet. In this way, the user's actuation of the trigger, and the positioning of the trigger, can be monitored and adjusted.

In addition to aiding in the actuation of the trigger itself, an alternate embodiment of the invention contemplates replacing the mechanical linkage between the trigger and the cocking/firing mechanism with a pneumatic operating system. In this embodiment of the invention, rearward movement of the trigger opens a pneumatic air valve. As the pneumatic air valve is opened, air pressure is supplied to an actuating ram coupled to the cocking ram of the paintball gun. When the actuating ram is pressurized, the air pressure of the actuating ram operates the cocking/firing mechanism to cause a paintball to be fired. In this manner, the air pressure of the actuating ram causes the mechanical movement of the cocking/firing mechanism, rather than a mechanical linkage between the trigger and the cocking/firing mechanism. The use of air pressure rather than the mechanical linkage allows for a faster and less physically demanding movement by the user on the trigger. After the firing sequence has been initiated, the residual pressure within the pneumatic valve aids in returning the trigger to its pre-firing position.

In addition to being used as an originally installed component, the assisted trigger mechanism of the present invention can be retrofit onto existing paintball guns while operating within the scope of the present invention.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
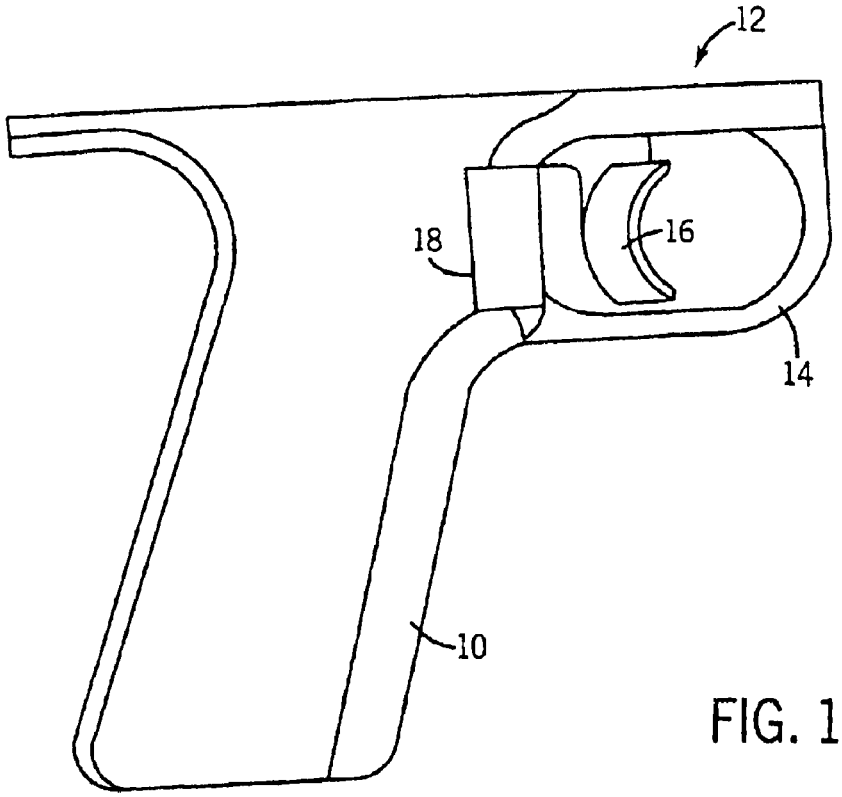
FIG. 1 is a side view illustrating the first embodiment of the assisted trigger mechanism of the present invention.

Referring first to FIG. 1, thereshown is a generally schematic illustration of a paintball gun incorporating the features of the present invention. The paintball gun includes a handle portion 10 that is grasped by a user during use of the paintball gun. The handle 10 is connected to a trigger mechanism 12 that includes a trigger guard 14 and the actual trigger 16. The trigger 16 is coupled to the cocking and firing components of the paintball gun such that depression of the trigger 16 will cause a paintball to be discharged from the paintball gun. The trigger mechanism 12 of the present invention is a conventional mechanism used in currently available paintball guns. The present invention, as will be described in detail below, provides assistance to the user to increase the rate at which the trigger can be pulled and returned to its resting position. In general, the present invention is directed to an active and passive system that aids the user in increasing the rate at which the trigger 16 can be depressed.

In the first embodiment of the invention, as shown in FIG. 1, a secondary magnet 18 is positioned within the trigger housing behind the actual trigger 16. In the preferred embodiment of the invention, the secondary magnet 18 could be either a natural magnet or an electromagnet that can be energized by an external circuit (not shown). In the embodiment of the invention illustrated in FIG. 1, the trigger 16 also includes a trigger-mounted primary magnet having a known polarity.

In the embodiment of the invention in which the magnet 18 is a natural magnet, the magnet is oriented such that its polarity is aligned in the direction of trigger travel. The polarity of the secondary magnet 18 is arranged such that the polarity of the secondary magnet 18 and the polarity of the trigger mounted magnet are opposite such that as the trigger 16 moves toward the magnet 18, the magnet 18 repels the trigger to provide an assisted return for the trigger 16. The strength and position of the secondary magnet 18 are selected such that the secondary magnet 18 repels the trigger 16 only after the trigger 16 has been depressed far enough to actuate the sear. After the sear has been actuated, the secondary magnet aids in returning the trigger to the resting position.

In an alternate embodiment in which the secondary magnet 18 is an electromagnet, the polarity of the secondary magnet 18 and the polarity of the trigger mounted magnet are opposite such that the trigger is initially attracted toward the secondary magnet 18. Once the trigger 16 activates the sear for the paintball gun, a sensor detects such movement and the polarity of the secondary magnet 18 is reversed, such that the secondary magnet 18 repels the trigger 16 to aid in returning the trigger 16 to its resting position prior to actuation of the next firing sequence.

Figure 2:
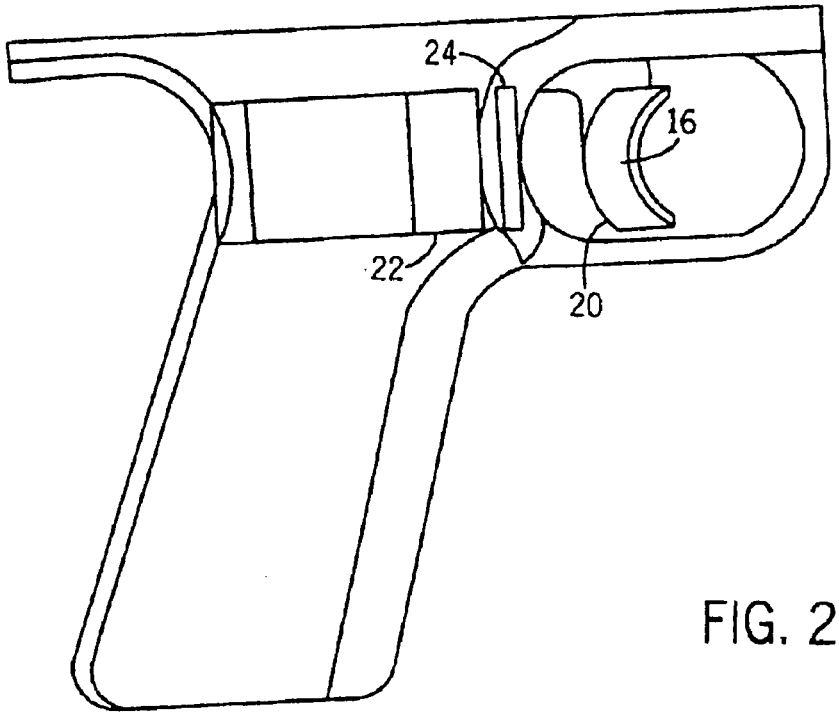
FIG. 2 is a second embodiment of the assisted trigger mechanism of the present invention, illustrating a force limiting element between the actuator and trigger.

Referring now to FIG. 2, thereshown is an alternate configuration of the embodiment shown in FIG. 1. As illustrated in FIG. 2, the trigger 16 includes a trigger magnet 20 and a secondary magnet 22 is positioned within the trigger housing. In the embodiment of the illustrated in FIG. 2, a shim 24 is positioned between the secondary magnet 22 and the trigger magnet 20. The shim 24 is formed from a material that, when placed in front of the secondary magnet 22, reduces the strength of the magnetic field emanating from the secondary magnet 22. Thus, each individual shim 24 reduces the magnetic field by a predetermined amount. In this manner, the attraction force between the secondary magnet 22 and the trigger magnet 20 can be adjusted such that the secondary magnet 22 repels the trigger only after the sear of the paintball gun has been activated. Thus, the shim 24 helps control the amount of assistance provided by the trigger mechanism of the present invention.

Figure 3:
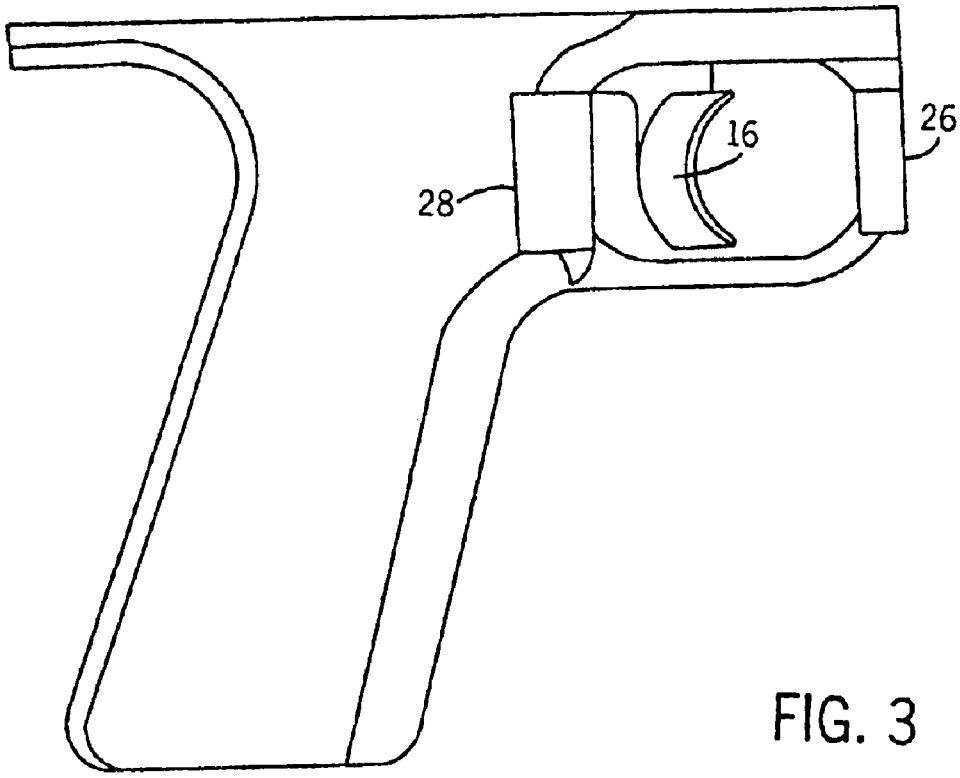
FIG. 3 is side view of the third embodiment of the assisted trigger mechanism of the present invention.

Referring now to FIG. 3, thereshown is another alternate embodiment of the assisted trigger mechanism of the present invention. In the embodiment of the invention illustrated in FIG. 3, the trigger 16 is configured as part of either an electromagnet or a natural magnet. The mechanism includes a secondary magnet 26 positioned in front of the trigger 16 and a secondary magnet 28 positioned behind the trigger 16. As the trigger 16 is activated, the trigger 16 causes a circuit between the trigger 16 and a power supply to be closed. The power supply causes the magnetic field created by the secondary magnet 26 to repel the trigger 16, while the magnetic field created by the secondary magnet 28 positioned behind the trigger 16 attracts the trigger. Once the trigger 16 has traveled past the point where it actuates the sear mechanism, the circuit to the electromagnets is open, causing a cessation of the magnetic field. Once the trigger 16 has traveled a minute but discernable distance beyond that required to cause the firing event, the circuit is again closed, such that the polarity of the magnetic fields of the secondary magnet 26 and the secondary magnet 28 are reversed. At this point in the trigger cycle, the magnetic fields repel the trigger from the secondary magnet 28 behind the trigger, while the secondary magnet 26 in front of the trigger attracts the trigger 16.

In the preferred embodiment of the invention shown in FIGS. 1–3, an adjustment mechanism can be utilized for each of the secondary magnets that allows the magnet to be moved closer or farther away from the trigger and the trigger-mounted primary magnet. In one embodiment, the secondary magnet can be mounted on a screw that can be threaded into the body of the mechanism housing the trigger, such that the depth or height of the screw can be adjusted externally. In another embodiment, the adjustment mechanism consists of a holder, into which secondary magnets of differing strengths can be placed.

In yet another embodiment, the adjustment mechanism consists of a secondary magnet that has been machined to include external threads on the outer circumference of the magnet and a tool socket is formed on the outward face of the magnet, such as a slot or hex-head. In this embodiment, the magnet is placed into a threaded channel machined into the trigger mechanism which houses the return mechanism. In another alternate embodiment, the threaded channel can be cut into the center of the magnet, allowing it to be placed on the adjustment screw. By providing such adjustment mechanisms, the strength of each secondary magnet can be adjusted to vary the amount of attraction and repulsion forces created during the trigger cycle.

Figure 4:
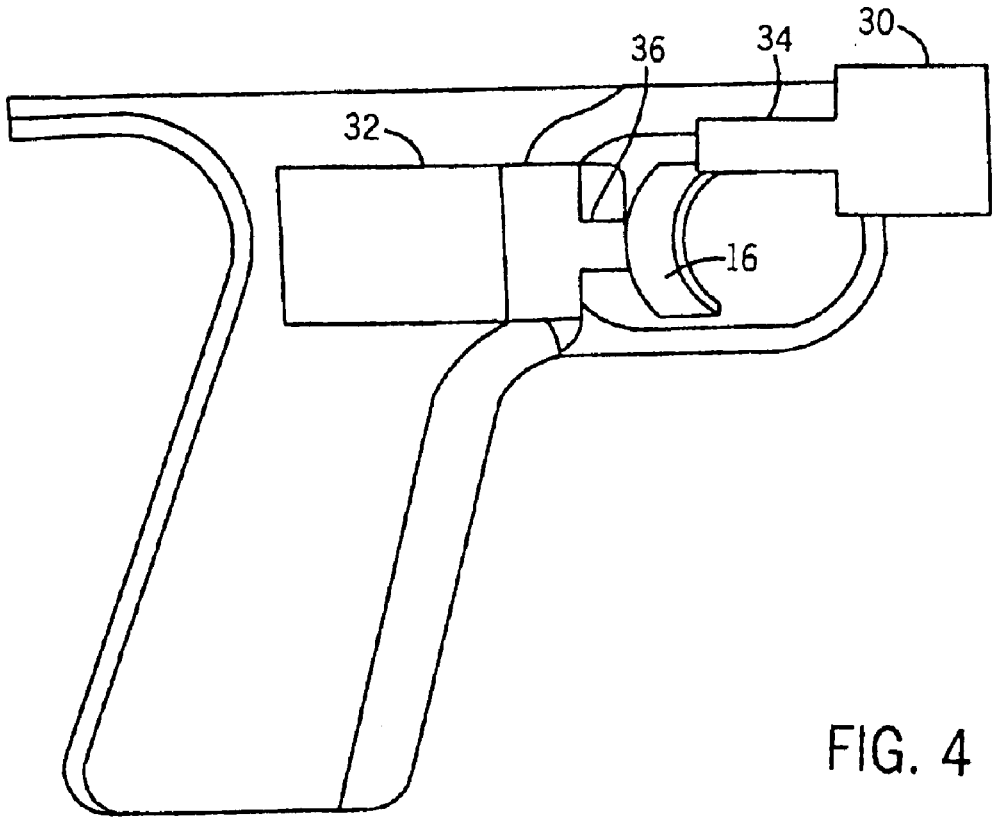
FIG. 4 is a fourth embodiment of the assisted trigger mechanism of the present invention.

Referring now to FIG. 4, thereshown is yet another alternate embodiment of the assisted trigger mechanism of the present invention. In the embodiment illustrated in FIG. 4, a pair of solenoids 30 and 32 are connected to the trigger 16. The solenoid 30 includes a solenoid rod 34 while the solenoid 32 includes its own solenoid rod 36. As the trigger 16 is depressed, the trigger 16 trips a sensor which supplies power to the solenoid 30. When actuated, the solenoid 30 extends the solenoid rod 34 to aid in movement of the trigger 16 to the firing position.

As the trigger 16 continues its rearward movement, the trigger further trips a sensor indicating that the trigger 16 has activated the sear mechanism. After actuating the sear mechanism, power is supplied to the solenoid 32, which extends the solenoid rod 36. Extension of the solenoid rod 36 aids in returning the trigger 16 to its resting position prior to initiation of the firing sequence.

Figure 6:
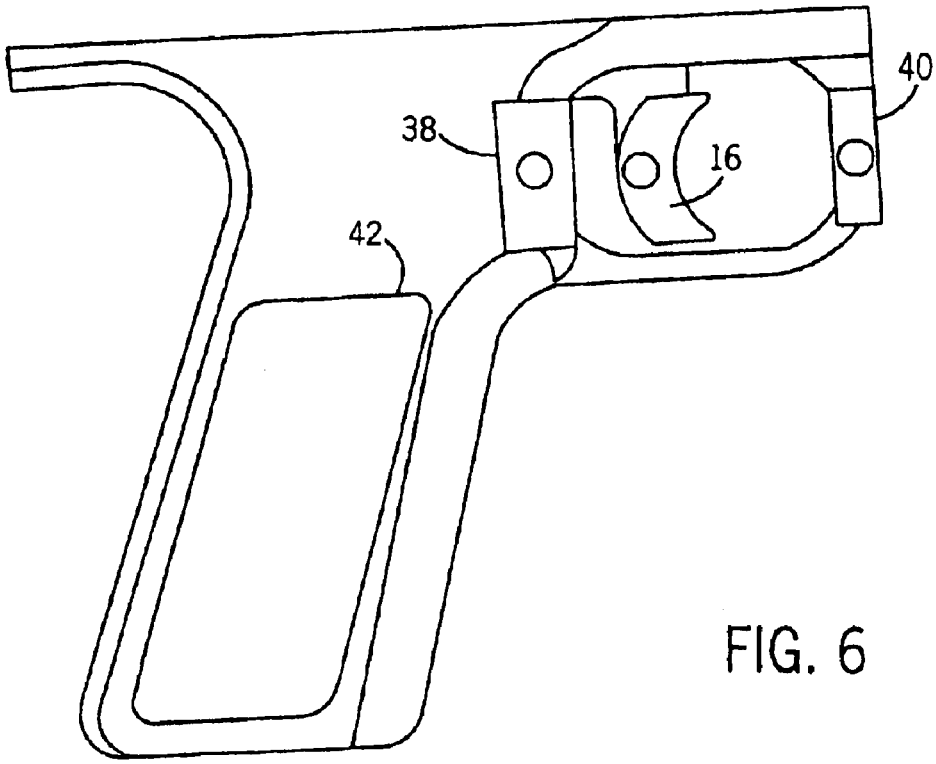
FIG. 6 is a side view of the sixth embodiment of the assisted trigger mechanism of the present invention.

Referring now to FIG. 6, thereshown is another embodiment of the invention in which a pair of sensors 38 and 40 are positioned on opposite sides of the trigger 16. The sensors 38 and 40 detect the movement of the trigger between its operating positions. The sensors 38 and 40 are coupled to a circuit board 42 mounted in the handle of the paintball gun. The circuit board 42 includes various logic elements, electronic connections between the circuit and sensors and switches, electronic connections to pneumatic, electronic, magnetic or other types of actuating devices, and interconnected power supplies. The electronic circuit contained on the circuit board 42, through communications with the sensors 38 and 40, can track, analyze and respond to the operation of the trigger by the user and will assist both the actuation and return of the trigger as desired.

Figure 5:
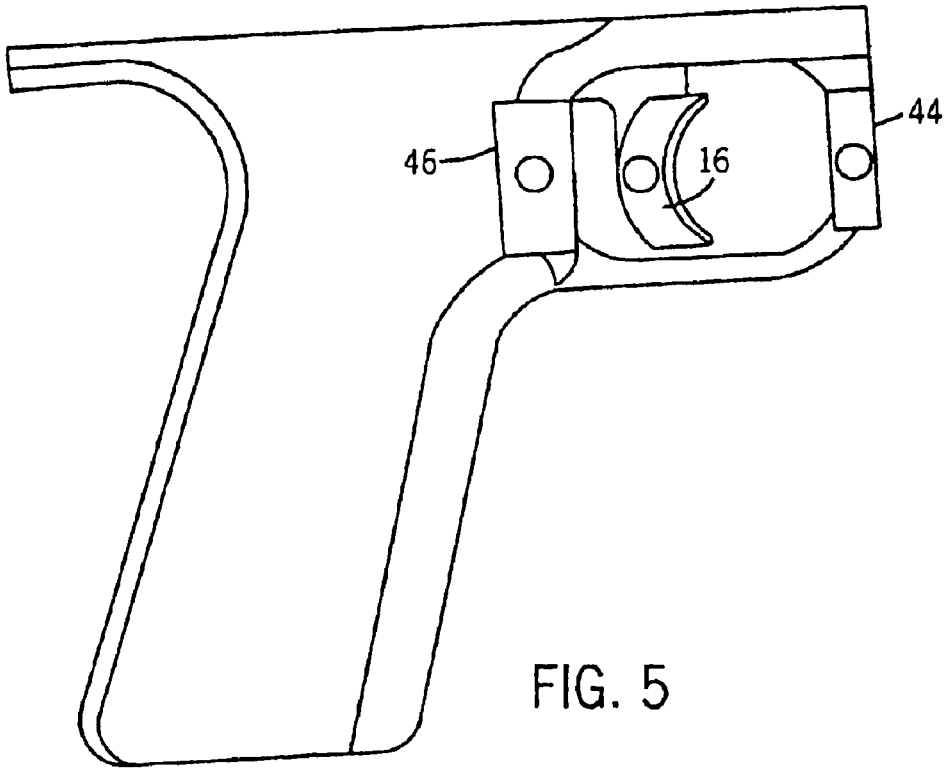
FIG. 5 is a side view of the fifth embodiment of the assisted trigger mechanism of the present invention.

Referring now to FIG. 5, Hall effect sensors 44 and 46 are positioned relative to the trigger 16 such that as the trigger 16 moves toward one of the sensors 44 and 46, the change in field strength monitored by the sensors will alternately cause power to be transmitted to the electromagnets, such as shown in FIG. 3. Movement of the trigger 16 will thus cause the polarity of the electromagnets to change or will cut off the flow of power to the electromagnets 26 and 28. In this way, the user's actuation of the trigger 16, and the positioning of the trigger can be monitored and adjusted.

Although not shown in the drawings, in another alternate embodiment of the invention, a pneumatic on/off valve is positioned behind the trigger such that when the trigger is depressed far enough to actuate the sear of the paintball gun, the pneumatic on/off valve is opened. When the pneumatic on/off valve is opened, a ram is pressurized. As the ram is pressurized, an actuation rod extends to aid in moving the trigger back to its resting position.

In the embodiment of the invention described in FIGS. 1–6, the active trigger mechanism is used to aid in the depression and return of the trigger between its two operating positions. The mechanisms allow for the trigger to be depressed and released at a higher rate of speed to aid in increasing the number of paintballs that can be fired by the operator. However, in each embodiment, the active trigger mechanism is used to move the trigger itself, while the trigger is part of a cocking/firing mechanism used to operate the sear of the paintball gun.

Figure 7:
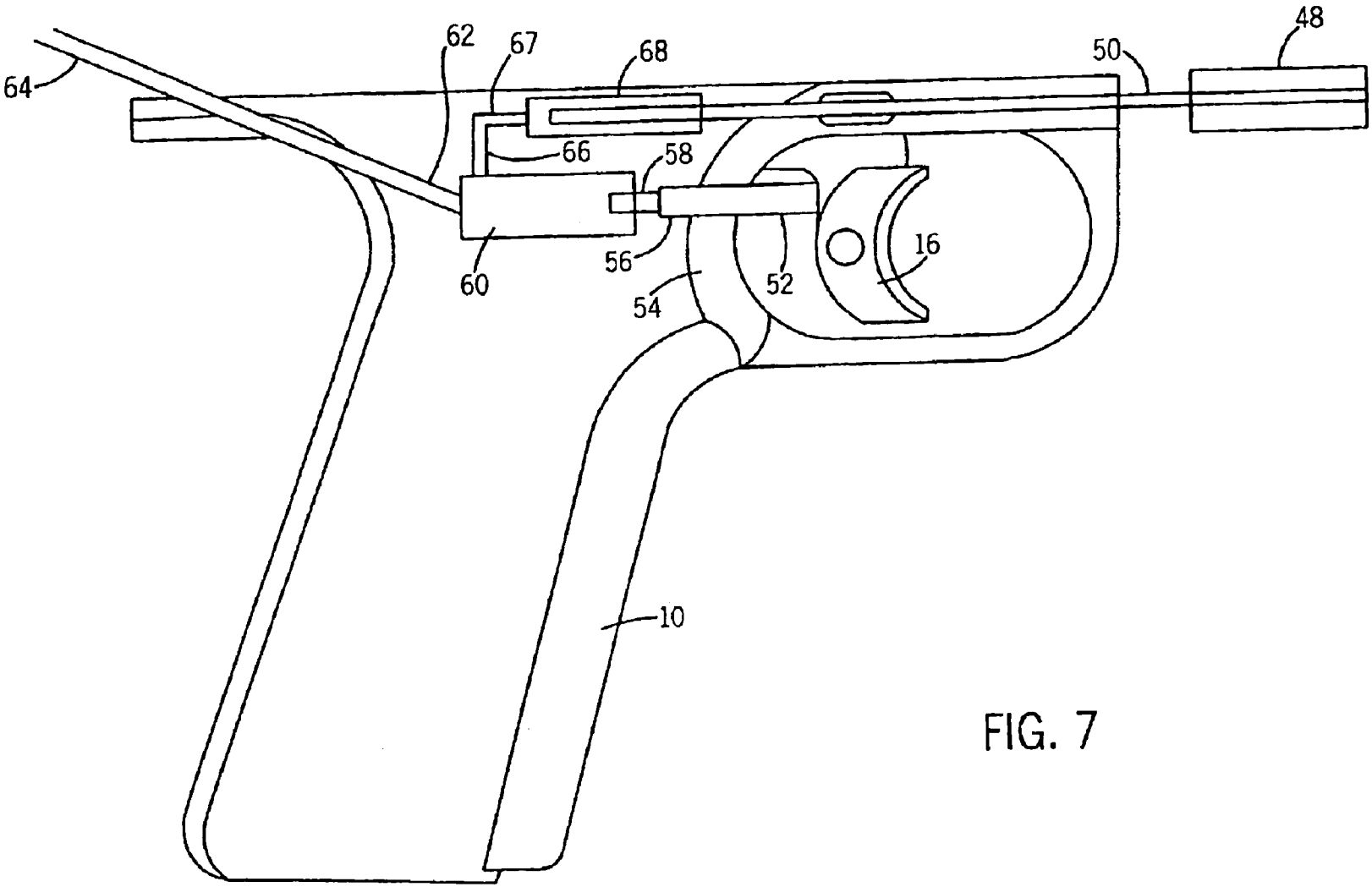
FIG. 7 is a side view illustrating an autococking mechanism constructed in accordance with the present invention.
Figure 8:
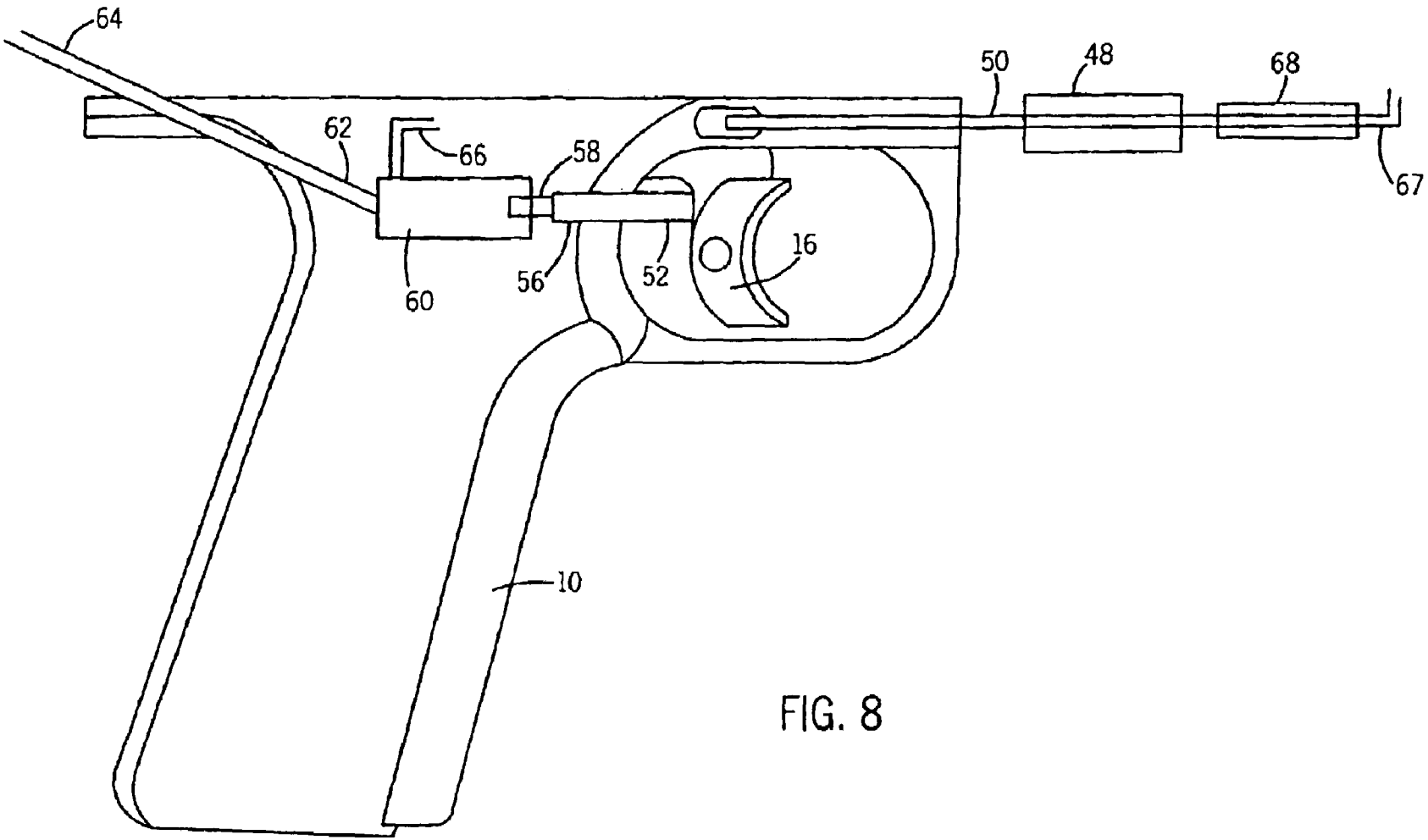
FIG. 8 is a second embodiment of the autococking mechanism incorporating the features of the present invention.

Referring now to FIGS. 7 and 8, thereshown is an alternate configuration that is utilized as an autococking mechanism, rather than simply a trigger return. In the embodiments illustrated in FIGS. 1–6, the trigger is mechanically coupled to the sear of the paintball gun such that the mechanical linkage between the trigger and the sear is used to both cock and fire the paintball gun. In the embodiment of the invention illustrated in FIGS. 7 and 8, the mechanical linkage between the trigger 16 and the sear is removed and a cocking ram 48 having an actuating rod 50 is coupled to the sear to effectuate the cocking and firing of the paintball gun. Thus, since the trigger 16 is no longer mechanically coupled to the sear, the trigger 16 can be depressed and released with less effort by the user.

As illustrated in FIG. 7, a rod 52 is coupled to the back side of the trigger 16 and extends through the trigger housing 54. The far end of the rod 56 is in contact with a movable plunger 58 of a pneumatic on/off valve 60. The pneumatic on/off valve 60 is contained in the handle 10 of the paintball gun. The on/off valve 60 includes an air inlet 62 that receives a supply of regulated air pressure from an external source 64, such as the air supply used to operate and fire paintballs from the paintball gun.

An outlet 66 from the on/off valve 60 supplies air pressure to an actuating ram 68 as illustrated. The actuating ram 68 receives the opposite end of the actuating rod 50.

During operation of the paintball gun, the user depresses the trigger 16 to move the trigger 16 rearward to fire a paintball. As the trigger 16 moves rearward, the rod 52 depresses plunger 58 which opens the on/off valve 60. When the on/off valve 60 is opened, the actuating ram 68 is pressurized through the air inlet 67. After being pressurized, the actuating ram 68 moves the actuating rod 50, which initiates the firing/cocking sequence for the paintball gun. As can be understood by the above description, the movement of the trigger pressurizes the actuating ram such that the actuating ram cocks and fires the paintball gun instead of a mechanical linkage between the trigger and the cocking/firing mechanism of the paintball gun.

Once the paintball has been fired, the trigger 16 is released, which closes the on/off valve 60. As the trigger is released, the residual pressure within the on/off valve 60 aids in pushing the plunger 58 and thus the rod 52 forward, acting as an active return for the trigger 16. Once the firing sequence is complete, the on/off valve 60 is vented and the system awaits the next firing sequence.

Turning now to FIG. 8, thereshown is an alternate embodiment of the invention illustrated in FIG. 7, with like parts having corresponding reference numerals. As illustrated in FIG. 8, the actuating ram 68 and the cocking ram 48 are connected in parallel with each other, unlike the opposed configuration illustrated in FIG. 7. The actuating ram 50 is received in both the cocking ram 48 and the actuating ram 68 and is coupled to the sear (not shown) of the paintball gun. As illustrated, the air outlet 66 from the on/off valve 60 is again received at an air inlet 67 for the actuating ram 68.

During operation of the invention illustrated in FIG. 8, the user initially pulls back the trigger 16, which again opens the on/off valve 60 by depressing the plunger 58. When opened, the on/off valve 60 supplies a source of pressurized air to the actuating ram 68 through the air inlet 67. Once pressurized, the actuating ram 68 moves the actuating rod 50 of the cocking ram 48 to begin the cocking sequence. Once the paintball has been fired, the trigger 16 is released and the residual pressure within the on/off valve 60 causes the plunger 58 to aid in the return of the trigger 16 to its previous position. Once again, the actuating ram 68 is vented to atmosphere such that the system is ready for the next firing sequence.

In the present invention, the first set of embodiments of FIGS. 1–7 illustrate a method and configuration to aid in moving the trigger between its two positions during the firing cycle. In these embodiments, the trigger is mechanically linked to the cocking and firing mechanism of the paintball gun such that the mechanism aids in reducing the amount of force required by the user to complete the firing sequence. By reducing the amount of force required, the speed of the firing sequence can be increased such that the number of paintballs fired by the user during a given time period can be increased.

In the second type of system, as illustrated in FIGS. 7 and 8, a mechanical linkage between the trigger and the cocking/firing mechanism for the paintball gun is eliminated and a pressurized actuating ram is used. In this system, the trigger closes an air valve, which begins the firing sequence. Once again, since the user does not need to actuate the mechanical linkage between the trigger and the cocking/firing mechanism, the rate at which the trigger can be pulled and released is increased, thus increasing the number of paintballs that can be fired during a given time period. In each of the two embodiments illustrated, assistance is given to the user during the trigger cycle such that the speed of the trigger cycle can be increased, effectively increasing the number of paintballs fired by a semi-automatic paintball gun.

Various alternatives and embodiments are contemplated as being within the scope of the following claims particularly pointing out and distinctly claiming the subject matter regarded as the invention.

I claim:

1. A method of assisting the cocking and firing of a paintball gun to increase the rate at which paintballs can be fired, the paintball gun including a cocking and firing mechanism including a cocking ram, the method comprising the steps of:

sensing the movement of a trigger of the paintball gun from a resting position to a firing position;

supplying a source of air pressure to an actuating ram, the actuating ram having an actuating rod that activates the cocking and firing mechanism of the paintball gun such that the actuating ram cocks and fires the paintball gun;

wherein the actuating ram is coupled to the cocking ram of the paintball gun; and wherein the actuating ram and the cocking ram are opposed.

2. A method of assisting the cocking and firing of a paintball gun to increase the rate at which paintballs can be fired, the method comprising the steps of:

sensing the movement of a trigger of the paintball gun from a resting position to a firing position;

supplying a source of air pressure to an actuating ram, the actuating ram having an actuating rod that activates a cocking and firing mechanism of the paintball gun such that the actuating ram cocks and fires the paintball gun;

positioning a primary magnet in the trigger of the paintball gun, the primary magnet being oriented such that the poles of the primary magnet extend along the line of movement of a trigger; and positioning a secondary magnet behind the trigger of the paintball gun, the secondary magnet being oriented such that the poles of the secondary magnet extend along the line of movement of the trigger;

wherein the poles of the secondary magnet are oriented such that the secondary magnet repels the primary magnet when the trigger moves toward the secondary magnet.

3. The method of claim 2 wherein both the primary magnet and the secondary magnet are electromagnets that are selectively operable.

4. A method of assisting the cocking and firing of a paintball gun to increase the rate at which paintballs can be fired, the method comprising the steps of:

sensing the movement of a trigger of the paintball gun from a resting position to a firing position; and, supplying a source of air pressure to an actuating ram, the actuating ram having an actuating rod that activates a cocking and firing mechanism of the paintball gun such that the actuating ram cocks and fires the paintball gun; and, wherein the step of supplying a source of air pressure to an actuating ram assists in moving the trigger from the resting position to the firing position.

5. The method of claim 4 further comprising the steps of assisting the return movement of the trigger from the firing position to the resting position.

* * * * *